US009944479B2

(12) United States Patent
Nakagawa

(10) Patent No.: US 9,944,479 B2
(45) Date of Patent: Apr. 17, 2018

(54) SHEET FEEDING APPARATUS AND IMAGE FORMING APPARATUS

(71) Applicant: CANON KABUSHIKI KAISHA, Tokyo (JP)

(72) Inventor: Hiroyuki Nakagawa, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/448,835

(22) Filed: Mar. 3, 2017

(65) Prior Publication Data

US 2017/0283200 A1 Oct. 5, 2017

(30) Foreign Application Priority Data

Mar. 31, 2016 (JP) ..... 2016-073539

(51) Int. Cl.

| | |
|---|---|
| ***B65H 1/26*** | (2006.01) |
| ***B65H 7/04*** | (2006.01) |
| ***B65H 1/04*** | (2006.01) |
| ***B65H 1/14*** | (2006.01) |
| ***B65H 3/66*** | (2006.01) |

(52) U.S. Cl.

CPC ..... *B65H 7/04* (2013.01); *B65H 1/04* (2013.01); *B65H 1/14* (2013.01); *B65H 3/66* (2013.01); *B65H 2402/442* (2013.01); *B65H 2801/06* (2013.01)

(58) Field of Classification Search

CPC ..... B65H 1/266; B65H 2402/31; B65H 2402/35; B65H 2405/32; B65H 2405/324; B65H 2405/354; B65H 2553/30; B65H 2553/41; G03G 15/6517

USPC ..... 271/9.09, 162

See application file for complete search history.

(56) References Cited

FOREIGN PATENT DOCUMENTS

| | | | |
|---|---|---|---|
| JP | 04-164743 A | | 6/1992 |
| JP | 2011-006239 A | | 1/2011 |
| JP | 2011225293 A | * | 11/2011 |
| JP | 2015-168539 A | | 9/2015 |

* cited by examiner

*Primary Examiner* — Michael C McCullough

(74) *Attorney, Agent, or Firm* — Fitzpatrick, Cella, Harper & Scinto

(57) ABSTRACT

A sheet feeding apparatus includes an apparatus body, and an opening/closing member openable/closable with respect to the apparatus body and including a support portion supporting a sheet in a condition in which the opening/closing member is opened. The sheet supported by the support portion is fed by a feed portion. The opening/closing member is provided with a detection portion configured to detect the sheet on the support portion. The detection portion is disposed at a position where a detection wave emitted from the detection portion is not detected in a condition in which the opening/closing member is closed.

23 Claims, 10 Drawing Sheets

SHEET FEEDING APPARATUS AND IMAGE FORMING APPARATUS

BACKGROUND OF THE INVENTION

Field of the Invention

The present invention relates to a sheet feeding apparatus configured to feed a sheet and an image forming apparatus including the sheet feeding apparatus.

Description of the Related Art

Some image forming apparatus such as a printer and a copier include a manual sheet feeding apparatus configured such that a user can manually set a sheet on a tray provided openably and closably on a side surface of a body of the apparatus (referred to as 'an apparatus body' hereinafter). The sheet stacked on the tray is delivered by a pickup roller for example and is fed into the apparatus body via a retard separation type separation nip portion.

Some manual sheet feeding apparatus also include a detector configured to detect whether or not a sheet is set on a feedable position on the tray. However, there is a case when a part of the sheet floats up from the tray and deviates from a detection range of the detector when, for example, an edge portion of the sheet is nipped by a nip portion, e.g., a separation nip portion, of a roller pair located downstream of the tray in a sheet feeding direction. In this case, the detector does not detect the sheet being nipped by the nip portion even though the sheet is in a condition being able to be fed when the roller pair rotates.

Japanese Patent Application Laid-open No. 2011-6239 discloses a manual sheet feeding apparatus including a transmission type photoelectric sensor detecting whether or not a sheet is loaded on a tray, a pushup plate configured to lift while supporting the sheet stacked on the tray, and a reflection type photoelectric sensor disposed on the pushup plate. The sheet stacked on the tray rises by being lifted by the pushup plate and abuts with one of a feed roller pair. The reflection type photoelectric sensor detects the sheet lifted by the pushup plate and nipped by the feed roller pair. Then, a control portion within the image forming apparatus determines whether or not a sheet feedable by the feed roller pair exists based on a detection signal from the transmission type and reflection type photoelectric sensors.

By the way, the apparatus of Japanese Patent Application Laid-open No. 2011-6239 described above needs the plurality of sensors to determine presence of a feedable sheet, and it becomes a hindrance in cutting a cost of the image forming apparatus. Accordingly, it has been needed to be able to accurately detect whether or not a sheet exists and to cut the cost at the same time.

SUMMARY OF THE INVENTION

The present invention provides a sheet feeding apparatus capable of detecting a sheet supported on a support portion and of reducing erroneous detection with a simple structure.

According to a first aspect of the invention, a sheet feeding apparatus includes an apparatus body, an opening/closing member openable and closable with respect to the apparatus body and including a support portion configured to support a sheet in a condition in which the opening/closing member is opened, a feed portion configured to feed the sheet supported on the support portion, and a detection portion disposed in the opening/closing member and configured to emit a detection wave in a direction intersecting with a support surface of the support portion and detect the detection wave reflected by the sheet on the support surface, the detection portion being disposed at a position where the detection wave emitted from the detection portion is not detected by the detection portion in a condition in which the opening/closing member is closed.

According to a second aspect of the invention, a sheet feeding apparatus includes an apparatus body, an opening/closing member openable and closable with respect to the apparatus body and including a support portion configured to support a sheet in a condition in which the opening/closing member is opened, a feed portion configured to feed the sheet supported on the support portion, a conveyance guide disposed in the apparatus body and configured to guide the sheet fed by the feed portion, the conveyance guide including a first guide portion configured to be in sliding contact with a first surface of the sheet conveyed by the feed portion and a second guide portion configured to be in sliding contact with a second surface opposite to the first surface of the sheet, and a detection portion disposed in the opening/closing member and configured to emit a detection wave in a direction intersecting with a support surface of the support portion and detect the detection wave reflected by the sheet on the support surface, the detection portion being disposed at a position overlapping with an opening of a sheet conveyance path defined between the first and second guide portions when viewed from a direction in which the detection wave is emitted from the detection portion in a condition in which the opening/closing member is closed.

According to a third aspect of the invention, a sheet feeding apparatus includes an apparatus body, an opening/closing member openable and closable with respect to the apparatus body and including a support portion configured to support a sheet in a condition in which the opening/closing member is opened, a feed portion configured to feed the sheet supported on the support portion, a conveyance guide disposed in the apparatus body and configured to guide the sheet fed by the feed portion, and a detection portion disposed in the opening/closing member and configured to emit a detection wave in a direction intersecting with a support surface of the support portion and detect the detection wave reflected by the sheet on the support surface, the detection portion being disposed at a position where the detection wave is emitted by the detection portion in a direction passing through inside of a sheet conveyance path defined by the conveyance guide in a condition in which the opening/closing member is closed.

According to a fourth aspect of the invention, a sheet feeding apparatus includes an apparatus body, an opening/closing member openable and closable with respect to the apparatus body and including a support portion configured to support a sheet in a condition in which the opening/closing member is opened, a feed portion configured to feed the sheet supported by the support portion, a detection portion disposed in the opening/closing member and configured to emit a detection wave in a direction intersecting with a support surface of the support portion and detect the detection wave reflected by the sheet on the support surface, and a regulating portion which is disposed in the apparatus body and against which the sheet supported on the support portion abuts so that a sheet position in a sheet feeding direction of the feed portion is regulated in a condition in which the opening/closing member is opened. The regulating portion includes a transmissive portion through which the detection wave emitted from the detection portion passes. The detection portion is disposed at a position where the detection wave is emitted in a direction passing through the transmissive portion in a condition in which the opening/closing member is closed.

According to a fifth aspect of the invention, a sheet feeding apparatus includes an apparatus body, an opening/closing member openable and closable with respect to the apparatus body and including a support portion configured to support a sheet in a condition in which the opening/closing member is opened, a feed portion configured to feed the sheet supported on the support portion, a detection portion disposed in the opening/closing member and configured to emit a detection wave in a direction intersecting with a support surface of the support portion and detect the detection wave reflected by the sheet on the support surface, and a low reflectance portion disposed in the apparatus body and facing the detection portion in a condition in which the opening/closing member is closed, the low reflectance portion having reflectance to the detection wave from the detecting portion lower than that of surrounding portions of the low reflectance portion.

Further features of the present invention will become apparent from the following description of exemplary embodiments with reference to the attached drawings.

DESCRIPTION OF THE EMBODIMENTS

A sheet feeding apparatus of the present disclosure and an image forming apparatus including the sheet feeding apparatus will be described below with reference to the drawings.

First Embodiment

Figure 1:
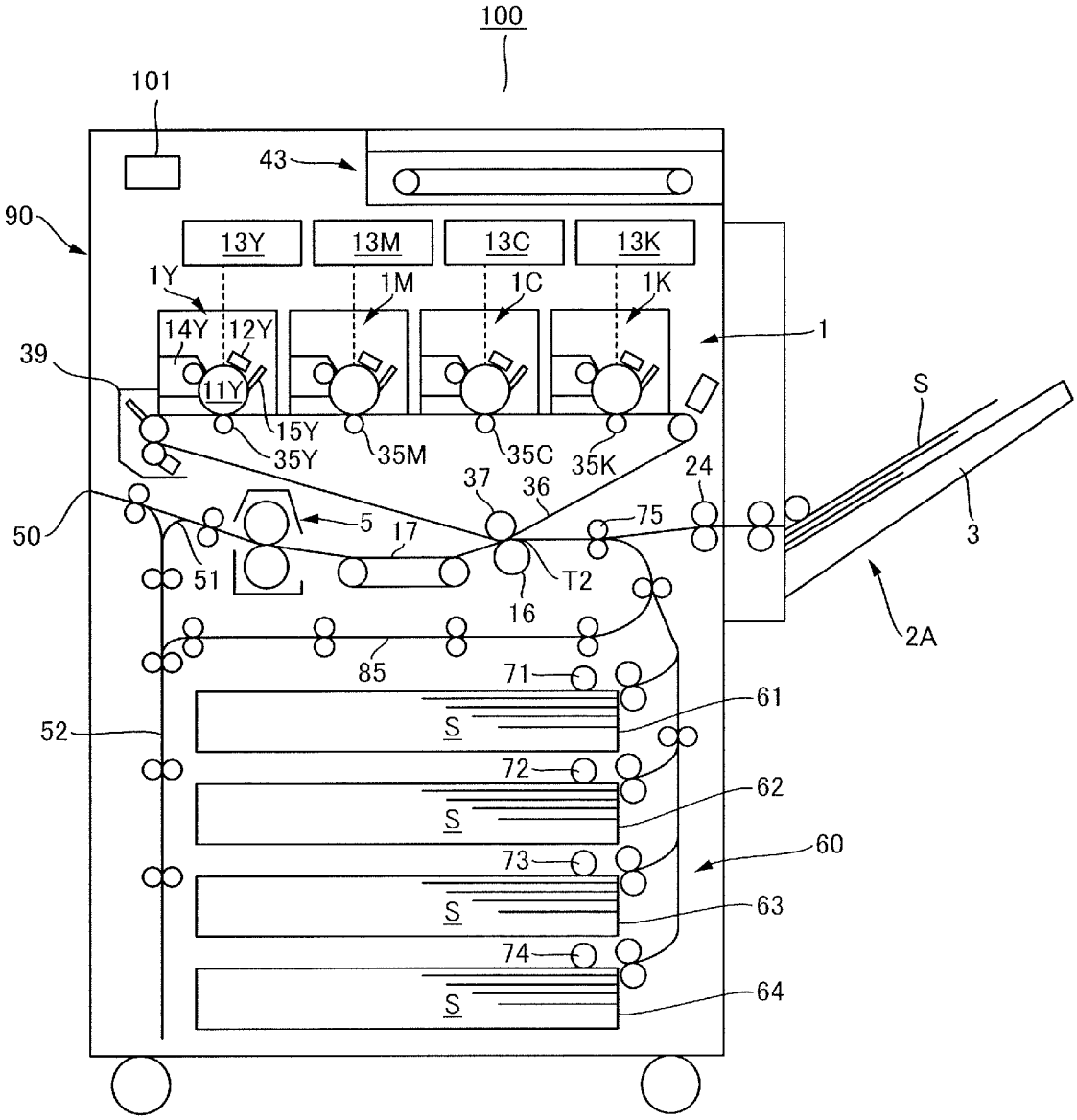
FIG. 1 is a schematic diagram illustrating a configuration of an image forming apparatus of the present disclosure.

An image forming apparatus 100 of a first embodiment is a copier including an one exemplary image forming portion 1 serving as an image forming portion for forming a toner image onto a sheet S as FIG. 1 illustrates a schematic structure thereof. The toner image formed by the electrophotographic image forming portion 1 is primarily transferred onto an intermediate transfer belt 36 and is then secondarily transferred onto the sheet S fed from a sheet feeding apparatus 2 or 60 at a secondary transfer portion T2.

A document reading apparatus 43 configured to read an image of a document is disposed above an apparatus body 90 of the image forming apparatus 100. The document reading apparatus 43 includes a scanning optical system not illustrated and configured to scan and to photo-electrically convert the document image into image information. The document reading apparatus 43 then converts the image information into electronic signals to transfer to the image forming portion 1.

The image forming portion 1 is composed of four image forming stations 1Y, 1M, 1C and 1K forming toner images of yellow (Y), magenta (M), cyan (C) and black (K). Because configurations of the respective image forming stations are approximately the same except for the colors of toners used in development, the following description will be made by exemplifying the image forming station 1Y of yellow and description will be omitted about the other image forming stations 1M, 1C and 1K.

The image forming station 1Y includes a photosensitive drum 11Y, an electrifier 12Y, an exposure unit 13Y, a developing unit 14Y and a drum cleaner 15Y. The photosensitive drum 11Y, i.e., a drum-shape photoconductor, has a photosensitive layer made of an organic photoconductor (OPC) for example and rotates in a predetermined direction, e.g., clockwise in FIG. 1. The electrifier 12Y uniformly electrifies a surface of the photosensitive drum 11Y by way of corona electric discharge, proximity electric discharge or the like. The exposure unit 13Y includes a light emission portion such as a laser light source and a scanning optical system (both not illustrated) and irradiates the surface of the photosensitive drum 11Y with light based on the image information. Thereby, an electrostatic latent image corresponding to a monochromatic image of yellow is formed on the surface of the photosensitive drum 11Y.

The developing unit 14Y includes a developer bearing member configured to bear developer which contains toner. The toner borne on the developer bearing member is electrostatically adsorbed to the surface of the photosensitive drum 11Y in response to an electrical potential distribution of the electrostatic latent image, and the electrostatic latent image is developed as a toner image when a development bias voltage is applied to the developer bearing member. The toner image borne on the surface of the photosensitive drum 11Y is transferred onto the intermediate transfer belt 36 by an action of a primary transfer roller 35Y, to which a primary transfer bias voltage is applied. It is noted that adhesive materials such as toner left on the surface of the photosensitive drum 11Y without being transferred onto the intermediate transfer belt 36 is removed by the drum cleaner 15Y.

The intermediate transfer belt 36, i.e., an endless intermediate transfer member, is stretched around primary transfer rollers 35Y, 35M, 35C and 35K, a secondary transfer inner roller 37 and others, and is rotationally driven along a rotation direction of the respective photosensitive drums of the image forming portion 1. The image forming operation described above is carried out in parallel in the respective image forming stations 1Y, 1M, 1C and 1K, and toner images of the respective colors are superimposed and transferred onto the intermediate transfer belt 36 so as to overlap with each other.

The secondary transfer portion T2 is a nip portion composed of the secondary transfer inner roller 37 and a secondary transfer roller 16 facing the secondary transfer inner roller 37 while interposing the intermediate transfer belt 36. The toner image borne on the intermediate transfer belt 36 is transferred onto a sheet S by a secondary transfer bias voltage applied to the secondary transfer roller 16. It is noted that adhesive materials such as the toner left on the intermediate transfer belt 36 without being transferred onto the sheet S is removed by a belt cleaner 39.

Sheet Conveyance Operation

In parallel with the image forming process described above, the sheet S is fed from the sheet feeding apparatus to the secondary transfer portion T2. Here, the sheet S is a thin recording medium such as a sheet of paper such as a copy sheet, a plastic film such as an overhead transparency (OHT), and a cloth for example. The image forming apparatus 100 includes a front loading cassette type sheet feeding apparatus 60 provided at a lower part of the apparatus body 90 and a manual sheet feeding apparatus 2A provided on a side part of the apparatus body 90.

The cassette type sheet feeding apparatus 60 includes sheet feed cassettes 61, 62, 63 and 64 mounted drawably in the apparatus body 90 and feed portions 71, 72, 73 and 74 configured to feed the sheet S stored in the respective cassettes. The feed portions 71, 72, 73 and 74 separate the sheets (S) stored in the corresponding cassette one by one and convey to a registration portion 75. The manual sheet feeding apparatus 2A which will be detained later separates sheets (S) set on a tray unit 3 one by one and conveys toward the registration portion 75. The registration portion 75 corrects a skew of the sheet S and sends the sheet S toward the secondary transfer portion T2 while adjusting with a toner image transfer timing.

The sheet S onto which the toner image has been transferred at the secondary transfer portion T2 is conveyed to a fixing unit 5 through a pre-fixation conveyance portion 17, so as to fix the image by undergoing through heat and pressure. When the image forming process is completed, the sheet S is discharged out of the apparatus body 90 through a discharge port 50. In case of duplex printing on the other hand, the sheet S is passed to a reverse portion 52 by a switching portion 51 to reverse a front surface of the sheet S with a back surface thereof. Then, the sheet S is conveyed again to the registration portion 75 through a duplex conveyance portion 85, an image is formed and fixed onto the back surface of the sheet at the secondary transfer portion T2 and the fixing unit 5, and the sheet S is discharged out of the apparatus body 90.

Manual Sheet Feeding Apparatus

Figure 2A:
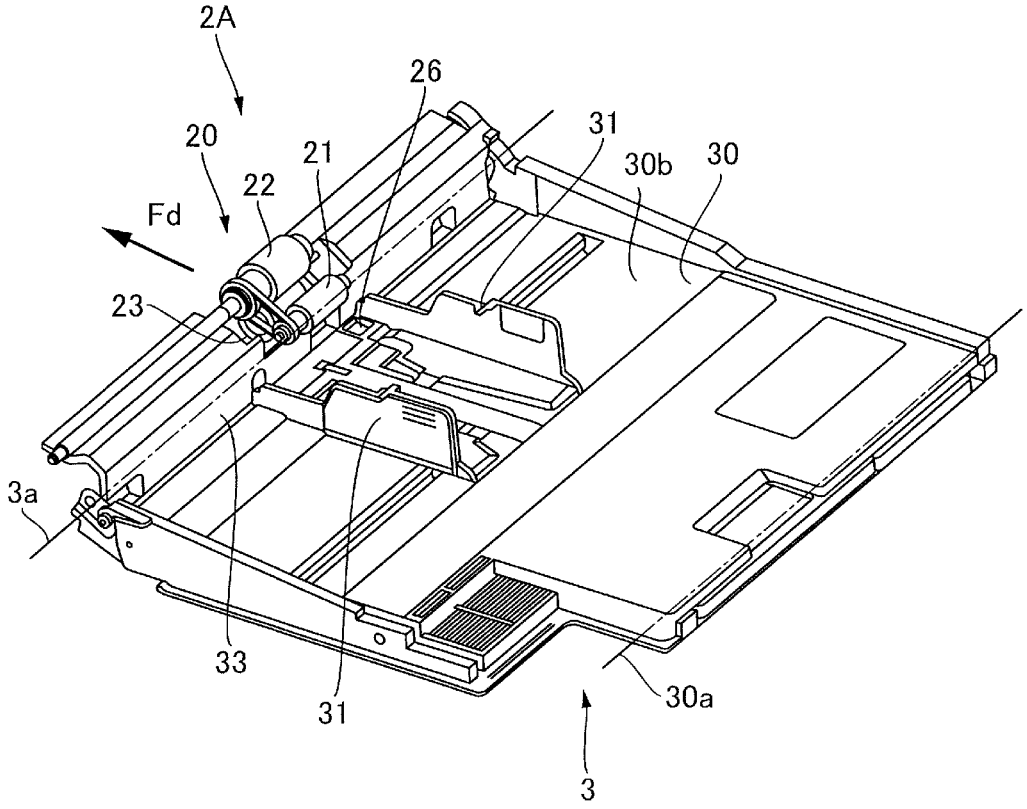
FIG. 2A is a perspective view of a manual sheet feeding apparatus of a first embodiment.

Next, the manual sheet feeding apparatus 2A, which is one exemplary sheet feeding apparatus, will be described below. The manual sheet feeding apparatus 2A is used in a case, for example, when the user manually supplies a sheet that is difficult to be stored in the sheet feed cassette such as a large size sheet, an envelope, and a coated sheet. As illustrated in FIG. 2A, the manual sheet feeding apparatus 2A includes a tray unit 3 which is an openable/closable member openable from and closable to the apparatus body 90 serving as an apparatus body of the sheet feeding apparatus in the present embodiment, and a feed unit 20 serving as a feed portion feeding the sheet S to the apparatus body 90.

Figure 3A:
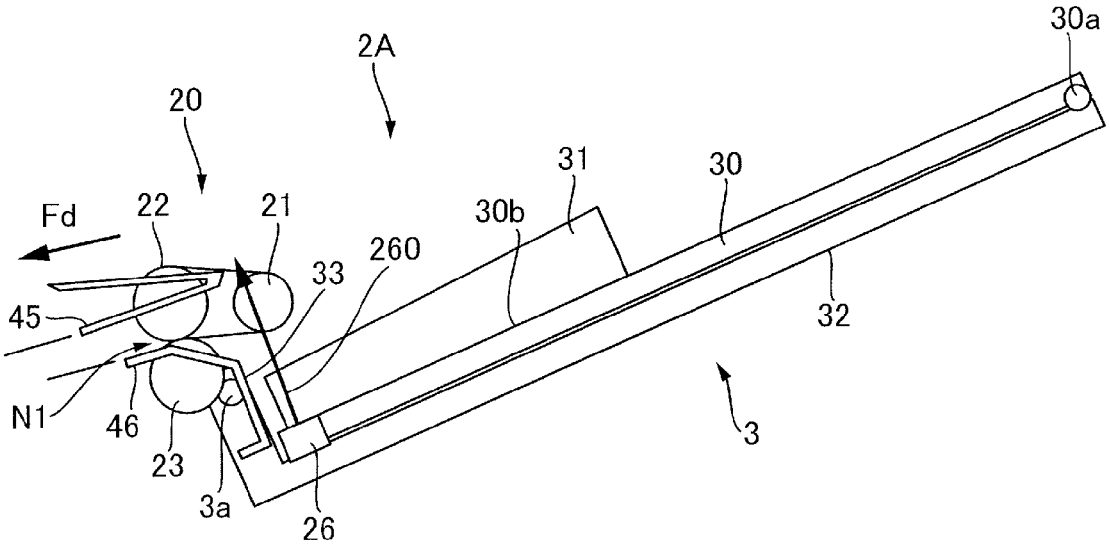
FIG. 3A is a section view illustrating a configuration of the manual sheet feeding apparatus.

As illustrated in FIG. 3A, which is a section view illustrating the configuration of the manual sheet feeding apparatus 2A, the tray unit 3 includes a tray body 32 and a sheet stacking plate 30 supported by the tray body 32. The tray body 32 is supported by the apparatus body 90 so as to be turnable centering on a tray opening/closing shaft 3*a*. Thereby, the tray unit 3 is movable between an open position in which the sheet can be loaded on the tray unit 3 and a closed position in which the tray unit 3 is stored in the side part of the apparatus body 90.

Figure 3B:
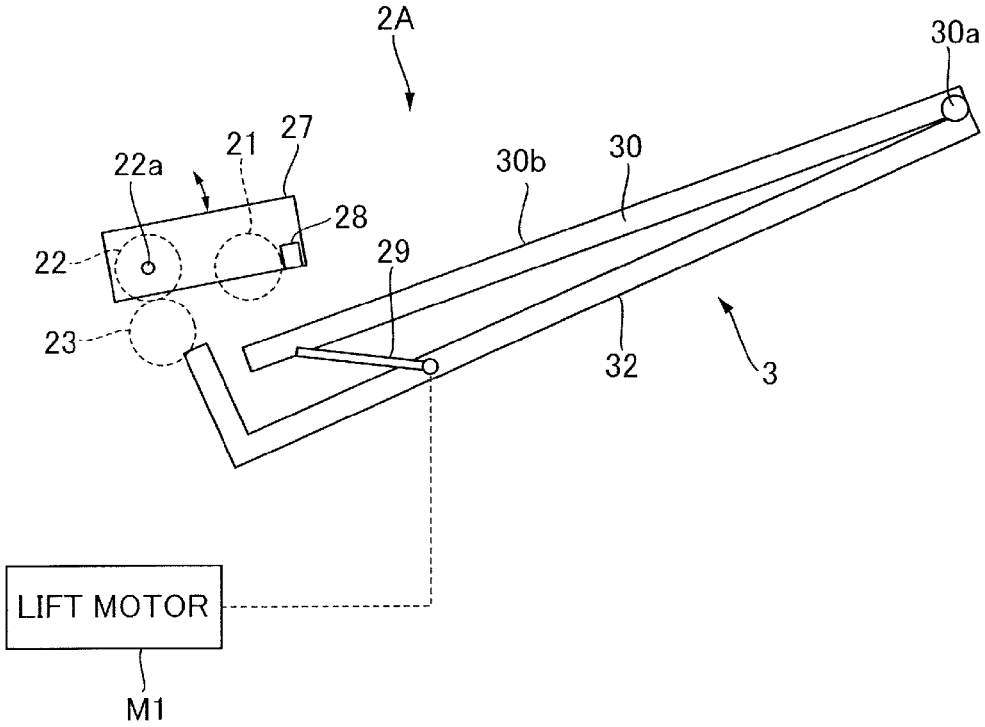
FIG. 3B is a diagram illustrating a configuration for lifting a sheet loading plate.

As illustrated in FIG. 3B, a sheet stacking plate 30, which serves as a support portion capable of supporting the sheet, is configured to swing upward and downward centering on a tray lifting shaft 30*a*, which is provided at an end of the tray unit 3 on a side distant from the tray opening/closing shaft 3*a*. A lift arm 29 driven by a lift motor M1 of the apparatus body 90 is disposed between the sheet stacking plate and a bottom of the tray body 32. Thereby, the sheet stacking plate 30 is movable between a feed position (see FIG. 3B) where the sheet S stacked on an upper surface 30*b* comes into contact with a pickup roller 21 of the feed unit 20 and a standby position (see FIG. 3A) where the sheet S separates from the pickup roller 21.

A position of the sheet S loaded on the upper surface 30*b*, i.e., a support surface, of the sheet stacking plate 30 is regulated by an abutting portion 33 provided on the apparatus body 90 and side regulating plates 31 provided in the tray unit 3 as illustrated in FIG. 2A. The abutting portion 33 serving as a regulating portion is arranged vertically and provided downstream of the sheet stacking plate 30 in a sheet feeding direction Fd of the feed unit 20. Accordingly, the abutting portion 33 regulates the position of the sheet in the sheet feeding direction by abutting with a leading edge (upstream end in the feed direction) of the sheet S. The side regulating plates 31, i.e., a pair of side end regulating members, are movable in directions symmetrical with respect to a center line of the sheet stacking plate 30 along a width direction orthogonal to the sheet feeding direction, and regulate a widthwise position of the sheet S.

As illustrated in FIG. 3A, the feed unit 20 includes a pickup roller 21, a feed roller 22, and a retard roller 23. The pickup roller 21 serving as a feed member abuts with the upper surface of the sheet S stacked on the sheet stacking plate 30 and delivers the sheet S in the sheet feeding direction Fd. The feed roller 22 serving as a conveyance member conveys the sheet S received from the pickup roller 21 further in the sheet feeding direction Fd. It is noted the sheet S delivered from the feed roller 22 is conveyed toward the registration portion 75 by a drawing roller 24 (see FIG. 1) disposed within the apparatus body 90.

The retard roller 23 serving as a separation member abuts with the feed roller 22 from underneath and forms a separation nip N1 serving as a separation portion. A rotation in a direction inverse to the sheet feeding direction is inputted to the retard roller 23 through a torque limiter not illustrated. Thereby, in a case when there is one or less sheet in the separation nip N1, the retard roller 23 rotates with the feed roller 22, and in a case when a plurality of sheets enter the separation nip N1, the retard roller 23 rotates inversely to push back the multiply fed sheets. In short, the feed unit 20 includes the separation mechanism of retard rotational separation in which sheets are separated by a rotary member which is driven inversely.

As illustrated in FIG. 3B, the pickup roller 21 is supported by a support member 27 turnable centering on a roller shaft 22*a* of the feed roller 22. Still further, the manual sheet feeding apparatus 2A is provided with a height detection sensor 28 disposed in the support member 27 for example and being capable of detecting a height of the sheet S stacked on the sheet stacking plate 30. The drive of the lift motor M1 is controlled based on a detection signal from the height detection sensor 28 to keep a height of an uppermost sheet constant so that the operation for delivering the sheet S executed the pickup roller 21 is stabilized.

Configuration for Detecting Sheet

Figure 2B:
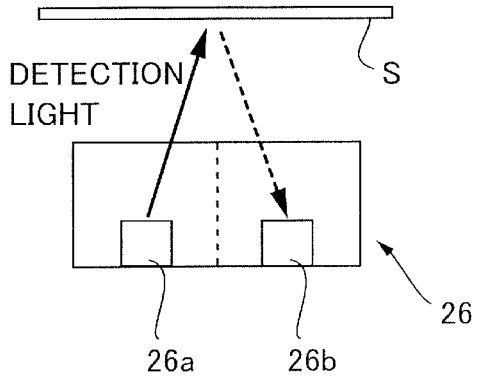
FIG. 2B is a diagram illustrating a sheet detection sensor.

Next, a configuration for detecting a condition of whether or not the sheet S set on the tray unit 3 is feedable will be described. As illustrated in FIGS. 2A and 2B, a sheet detection sensor 26, which serves as a detection portion for detecting the sheet S on the support portion, is provided in the sheet stacking plate 30. It is noted that "the sheet on the support portion" includes not only a sheet in contact with the support surface but also a sheet separated above from the support surface. The sheet detection sensor 26 is a reflection type photoelectric sensor including a light emission portion 26*a* emitting detection light as a detection wave above the sheet stacking plate 30 and a light reception portion 26*b* detecting the detection light reflected by the sheet S. In this case, a direction in which the detection light is projected, i.e., a direction of an optical axis of the detection light, corresponds to an emission direction of the detection wave.

A range in which the sheet detection sensor 26 can detect the sheet S will be referred to as a 'detection range' and a distance from the sheet detection sensor 26 to a boundary between the detection range and an outside thereof will be referred to as a 'detection limit distance' or 'non-detection distance' hereinafter. In other words, the detection range 260 is a range within which the sensor can stably detect a sheet regardless of a material or a size of the sheet as long as the sheet is in a range assumed to be used as the sheet S. Still further, the detection limit distance is a distance to a position of the boundary where a detection state of the sheet detection sensor 26 is switched to a non-detection state when the sheet S is moved along the optical axis of the detection light. Then, the detection range 260 is indicated by an arrow of a solid or broken line extending in the direction of the optical axis of the detection light with a length of the detection limit distance in FIGS. 3 through 10.

The sheet detection sensor 26 is disposed between movable ranges of the respective side regulating plates 31 in the width direction and on an outside of the pickup roller 21. In other words, the sheet detection sensor is disposed at a position not overlapping with the pickup roller in terms of the width direction. Thereby, the sheet detection sensor 26 can detect a sheet having a width suitable for stacking on the sheet stacking plate 30.

Figure 4:
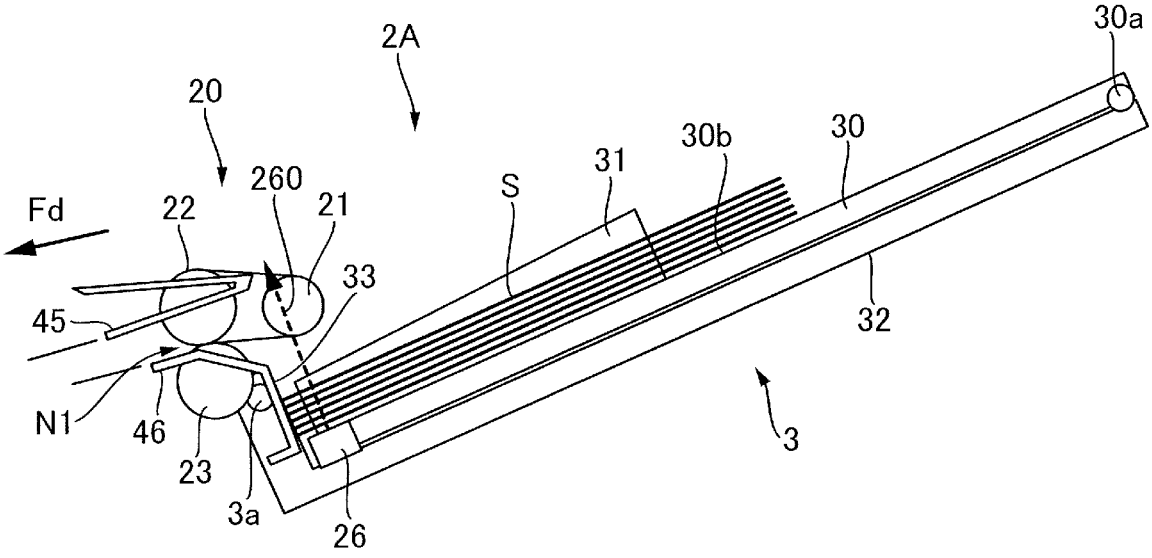
FIG. 4 is a section view of the manual sheet feeding apparatus illustrating a configuration for detecting the sheet set on a manual tray.

Still further, as illustrated in FIG. 4, the sheet detection sensor 26 is disposed at an end portion of the sheet stacking plate 30 and is located downstream of an abutment position where the pickup roller 21 abuts with the sheet S in terms of the sheet feeding direction Fd. In a case when the sheet S is disposed adequately in contact with the abutting portion 33 (see FIG. 4), the detection light of the sheet detection sensor 26 is blocked by the sheet S and the light reception portion 26*b* detects the detection light. That is, in a case when the sheet detection sensor 26 detects the detection light, there is at least one sheet S at the abutment position of the pickup roller 21. In this case, a control portion 101 (see FIG. 1) of the apparatus body 90 judges that the manual sheet feeding apparatus 2A is capable of feeding the sheet S.

Figure 5:
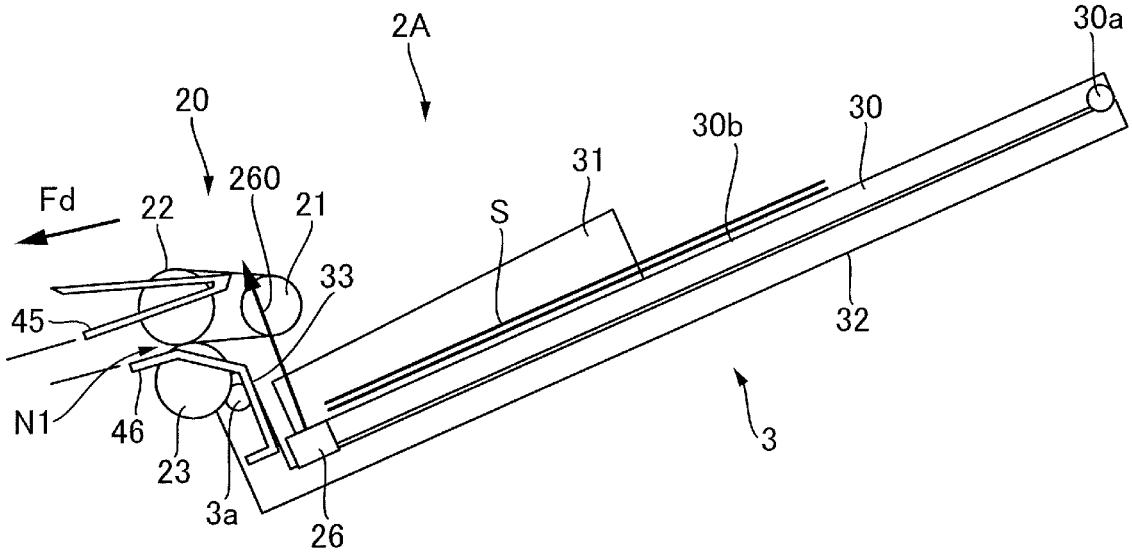
FIG. 5 is a section view illustrating the manual tray on which a sheet is set at an unfeedable position on the manual tray.

Meanwhile, if the sheet S is set carelessly as illustrated in FIG. 5, there may be a case when the sheet S deviates from the abutment position of the pickup roller 21. In this case, the sheet S deviates from the preset detection range 260 (and a maximum detection range) of the sheet detection sensor 26, and the sheet detection sensor 26 is unable to detect the detection light. At this time, the control portion 101 judges that the manual sheet feeding apparatus 2A is in a condition of being unable to feed a sheet, i.e., a sheetless condition.

In order to make the manual sheet feeding apparatus 2A into a feedable state, the sheet S needs to be present on the sheet stacking plate 30 and at a position where the sheet can abut with the pickup roller 21. In this respect, the sheet detection sensor 26 is configured to detect whether or not the sheet S exists and, when it detects the sheet S, to guarantee that the sheet S is consequently located at a position where the sheet S is fed at the same time.

It is also conceivable to dispose the sheet detection sensor 26 upstream of the abutment position of the pickup roller 21. In this case, however, it must be careful with a feed failure caused by erroneous recognition of the sheet position. That is, if the sheet S exists upstream of the abutment position of the pickup roller 21 and within the detection range of the sheet detection sensor 26, there is a possibility that the control portion 101 causes a feed failure by erroneously judging that the sheet S is feedable. However, the arrangement of the present embodiment makes it possible to prevent the control portion 101 from causing such feed failure.

Detection of Leaning Sheet

Figure 6A:
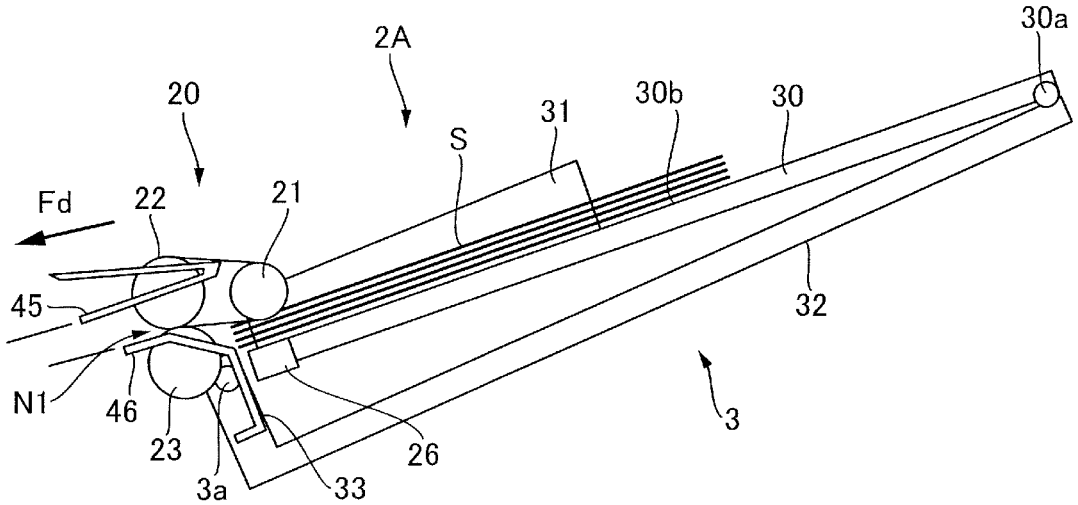
FIG. 6A is a section view illustrating the manual sheet feeding apparatus being under a feed operation.

Next, a feed operation of the manual sheet feeding apparatus 2A and 'leaning' of the sheet S will be explained. As illustrated in FIG. 6A, the sheet stacking plate 30 is lifted up to the feed position by the lift arm 29 prior to the feed operation. The sheet stacking plate 30 is controlled such that the sheet stacking plate 30 holds an uppermost sheet at a position of adequate height during when the feed unit 20 feeds a necessary number of sheets. Then, the sheet stacking plate 30 is moved downward toward the standby position when the feed operation ends as illustrated in FIG. 6B.

At this time, there is a case when the sheet stacking plate 30 is lowered in a condition in which the sheet S is nipped by the separation nip N1, while a downstream part in the sheet feeding direction of the sheet S floats up from the upper surface 30*b* of the sheet stacking plate 30. The condition in which the sheet S nipped by the separation portion leans against a guide member such as the guide portion 46 and a part of the sheet S separates from the sheet support surface of the support portion will be referred to as a leaning condition. While such a leaning condition occurs remarkably in a configuration in which the support portion is liftable, it can occur also in a configuration in which the support portion is not liftable. That is, a sheet may be put into the leaning condition in a configuration in which a nip portion nipping and conveying the sheet downstream of the support portion is located at a level higher than the sheet support surface of the support portion or above an extension line of the sheet support surface if the sheet support surface is inclined.

Figure 6B:
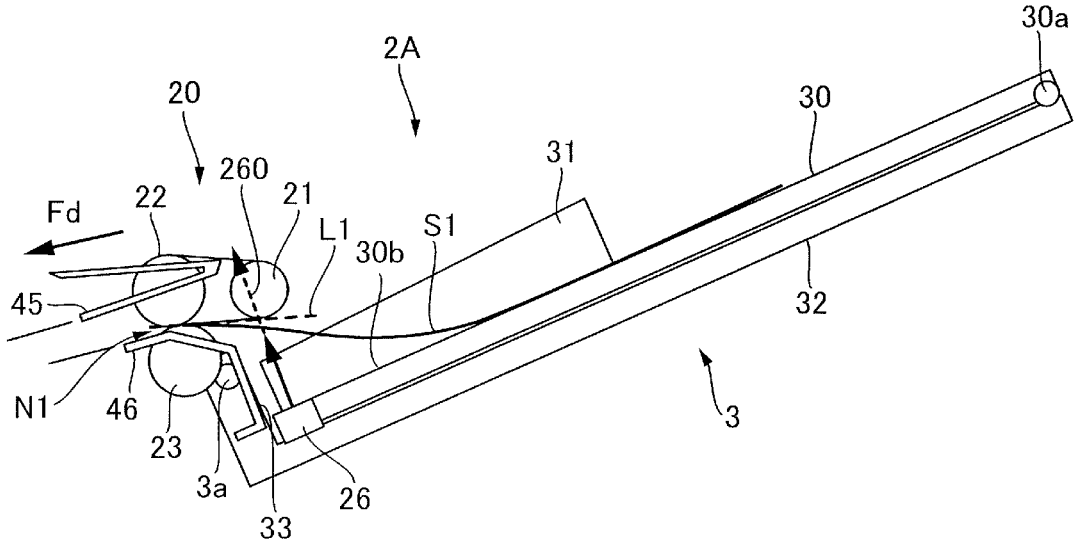
FIG. 6B is a section view of the manual sheet feeding apparatus in which leaning of the sheet has occurred.

In a case when the sheet S is in the leaning condition, i.e., a leaning sheet S1, exists as illustrated in FIG. 6B, it is preferable to be judged as being feedable. It is because the leaning sheet S1 can be fed normally by the feed roller 22 and the retard roller 23 even though it deviates from a regular set position because it is nipped by the separation nip N1.

According to the present embodiment, the detection range 260 of the sheet detection sensor 26 is set to be longer so as to detect the leaning sheet S1. Specifically, as illustrated in FIG. 6B, the detection range 260 of the sheet detection sensor 26 is arranged so as to intersect with a tangential line L1 of the feed roller 22 passing through the separation nip N1 when viewed from the width direction of the sheet. The control portion 101 judges whether or not the sheet is feedable by making reference to the detection signal from the sheet detection sensor 26 in commanding a start of the feed operation to the manual sheet feeding apparatus 2A in the condition in which the sheet stacking plate 30 is lowered.

An exemplary control made by using the detection signal of the sheet detection sensor 26 will be described below. In a case when the signal from the sheet detection sensor 26 is ON, i.e., a condition in which the detection light reflected from the sheet S is detected, there is on the sheet stacking plate 30 the sheet S set at the regular set position (see FIG. 4) or the leaning sheet S1 (see FIG. 6B). In this case, the control portion 101 lifts the sheet stacking plate 30 from the standby position to the feed position and, in parallel with this control, drives the feed unit 20. When the sheet stacking plate 30 arrives at the feed position, the sheet S set at the regular set position comes into contact with the pickup roller 21 and is fed by the feed unit 20. The leaning sheet S1 is also started to be conveyed at the same time when the feed roller 22 starts to be rotated.

Meanwhile, in a case when the signal of the sheet detection sensor 26 is OFF, i.e., a condition in which the detection light is not detected, the control portion 101 judges that no feedable sheet S including a leaning sheet S1 exists on the sheet stacking plate 30. In this case, the control portion 101 interrupts the feed operation and informs the user that setting of the sheet S is in failure by displaying, for example, an alarm on a control panel not illustrated.

In the present embodiment, the reflection type photoelectric sensor (photo-reflector) with a detection limit distance of 50.0 mm and a detection guaranteed distance of 1.5 to 22.0 mm can be used as the sheet detection sensor 26. Such a sensor enables reliable detection of the sheet S in contact with the sheet stacking plate 30 and the leaning sheet S1.

There is a conceivable configuration for detecting the sheet S1 in the leaning condition in which the reflection type sensor whose detection range is smaller than that described above on the sheet stacking plate 30 and to detect the leaning sheet S1 by bringing the sheet stacking plate 30 fully closer to the leaning sheet S1. However, this configuration needs a process of lifting the sheet stacking plate 30 to a level where it is possible to judge whether or not the leaning sheet S1 is feedable. Due to that, a delay occurs until informing the user that the sheet is not feedable. Besides that, the sheet stacking plate 30 is frequently lifted up and down, so that productivity may drop as compared to the present embodiment.

Prevention of Erroneous Detection in a Condition in which Tray is Closed

Next, configurations for realizing prevention of erroneous detection with a simple structure in using the reflection type sensor of the present embodiment will be described.

Figure 7:
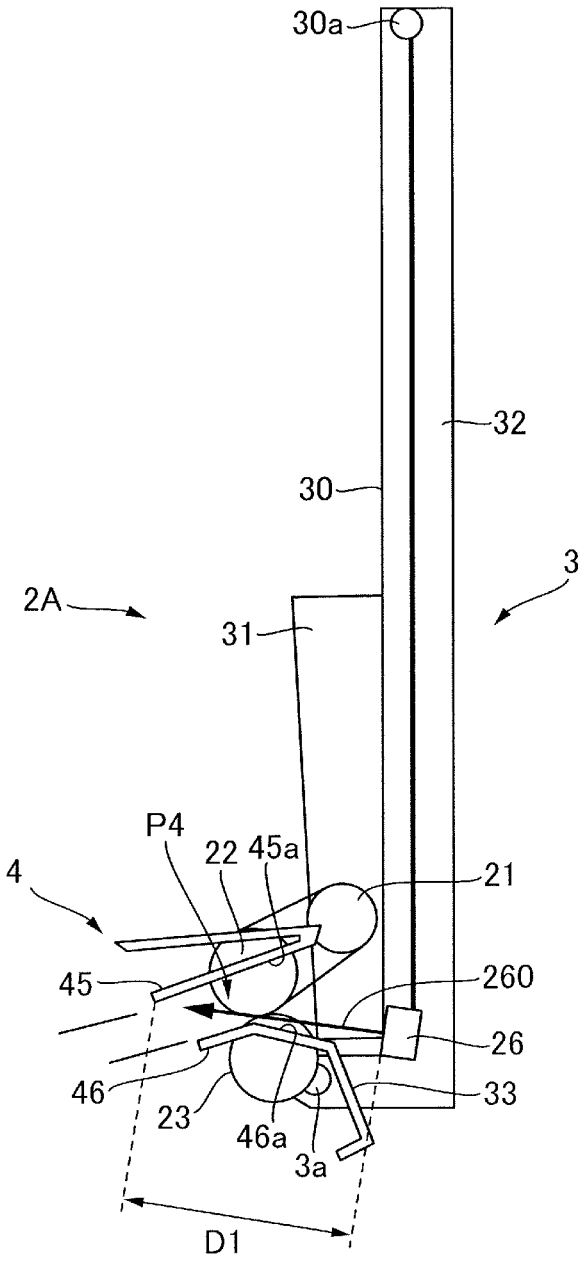
FIG. 7 is a section view of the manual sheet feeding apparatus in a condition in which the manual tray is closed.

As illustrated in FIG. 7, the tray unit 3 of the manual sheet feeding apparatus 2A is stored in the side part of the apparatus body 90 in a posture in which the tray body 32 is approximately vertical by being turned centering on the tray opening/closing shaft 3*a*. At this time, because the sheet detection sensor 26 is disposed on the tray unit 3, the emission direction of the detection light changes with a same angle with a turning angle required for opening/closing the tray unit 3. That is, in a condition in which the tray unit 3 is closed, the detection range 260 extends from the sheet detection sensor 26 to an inside of the apparatus body 90 with an angle close to a horizontal direction.

Here, there is a possibility that if a shielding object in the detection range 260 of the sheet detection sensor 26 presents in the condition in which the tray unit 3 is closed, the sheet detection sensor 26 turns ON and the control portion 101 erroneously judges the apparatus in a feedable state. The shielding object may be a guide member guiding a sheet conveyed by the feed unit 20 or a housing of the apparatus body 90. If such erroneous detection of the sheet detection sensor 26 occurs by such shielding object, the control portion 101 may command to start a feed operation, even though it is actually unable to feed any sheet, thus causing an erroneous operation. In some cases, the control portion 101 may detect some abnormality, e.g., an abnormal detection value of the height detection sensor 28, requiring a recovery work to be conducted by the user.

As a method for avoiding such trouble, it is conceivable to provide an opening/closing detection sensor configured to detect opening/closing of the tray unit 3. That is, with a sensor which turns ON/OFF corresponding to opening/closing of the tray unit 3, the control portion 101 is configured to command the manual sheet feeding apparatus 2A to start the feed operation only when the tray unit 3 is opened. However, such configuration needs at least the opening/closing detection sensor and a wiring structure thereof and hinders cost reduction.

Then, the present embodiment is arranged such that the detection range 260 of the sheet detection sensor 26 is positioned inside of a sheet conveyance path defined by the conveyance guide in the condition in which the tray unit 3 is closed.

As illustrated in FIG. 7, the manual sheet feeding apparatus 2A is provided with a guide portion 4 serving as a conveyance guide configured to guide the sheet S conveyed by the feed unit 20. The guide portion 4 is composed of an upper guide portion 45 and a lower guide portion 46. These upper and lower guide portions 45 and 46 are fixed to a frame body of the apparatus body 90. A guide surface 45*a* of the upper guide portion 45 corresponds to a first guide portion slidingly in contact with an upper surface, i.e., a first surface, of the sheet S, and a guide surface 46*a* of the lower guide portion 46 corresponds to a second guide portion slidingly in contact with a lower surface, i.e., a second surface opposite to the first surface. It is noted that the lower guide portion 46 is a plate member in which the guide surface 46*a* and the abutting portion 33 described above are formed in a body.

The guide surface 45*a* of the upper guide portion 45 faces the guide surface 46*a* of the lower guide portion 46 in terms of a vertical direction. Thereby, a sheet conveyance path P4 extending from an outside (right side in FIG. 7) to the inside (left side in FIG. 7) of the apparatus body 90 is defined between the upper and lower guide portions 45 and 46. The sheet conveyance path P4 overlaps with the separation nip N1 between the feed roller 22 and the retard roller 23 when viewed from an axial direction of the feed roller 22.

Then, an installation position and an installation angle of the sheet detection sensor 26 with respect to the sheet stacking plate 30 are set such that the emission direction of the detection light passes through inside of the sheet conveyance path P4 in the condition in which the tray unit 3 is closed. In other words, the sheet detection sensor 26 is disposed at a position overlapping with an opening of the sheet conveyance path P4 when viewed from the emission direction of the detection light in the condition in which the tray unit 3 is closed. Specifically, the upper guide portion 45 is located on an extension line of the optical axis of the detection light. Therefore, a distance D1 between the guide surface 45*a* of the upper guide portion 45 and the sheet detection sensor 26 is set to be longer than the detection limit distance in terms of the emission direction of the detection light. In conjunction with that the lower guide portion 46 is located under the optical axis of the detection light, the guide surfaces 45*a* and 46*a* of the upper and lower guide portions 45 and 46 are disposed outside of the detection range. Then, it is possible to prevent the sheet detection sensor 26 from causing an erroneous detection by thus leaving the distance D1 from the sheet detection sensor 26 to the guide surface 45*a*, which is a shielding object of the detection light, more than the detection limit distance in the condition in which the tray unit 3 is closed. It is noted that although the distance D1 is preferable to be longer than the detection limit distance, the distance D1 is not always necessary to be longer than the detection limit distance because reflectance of the detection light of a sheet is different from that of the guide surface 45*a*. It is possible to set the distance D1 to be shorter than the detection limit distance if reflectance of the shielding object is lower than that of sheets.

Still further, the sheet detection sensor 26 is disposed such that the emission direction of the detection light is inclined with respect to a direction perpendicular to the upper surface of the sheet stacking plate 30 (see FIG. 7) corresponding to a positional relationship with the sheet conveyance path P4. That is, the detection portion emits the detection wave in a direction intersecting with the support surface. It is noted that the emission direction of the detection light is set in a range in which the sheet detection sensor 26 can detect the sheet S downstream of the abutment position where the pickup roller 21 abuts with the sheet S. This arrangement makes it possible to readily realize an arrangement in which the detection range of the sheet detection sensor 26 is located inside of the sheet conveyance path P4.

It is noted that although the detection range 260 of the sheet detection sensor 26 is illustrated as an arrow along the optical axis of the detection light for convenience of the description, an actual detection range has a spatial expansion more or less around the arrow due to diffusion of the detection light and other factors. Accordingly, it is preferable to dispose the guide surfaces 45*a* and 46*a* of the upper and lower guide portions 45 and 46 separately in the vertical direction corresponding to response characteristics of the sheet detection sensor 26 with respect to the optical axis of the detection light. However, this is not applicable to a case when a detection light whose straightness is high such as laser light is used.

As described above, the present embodiment is arranged such that the emission direction, in which the detection light is emitted from the sheet detection sensor 26 in the condition in which the tray unit 3 is closed, is directed to pass through inside of the sheet conveyance path P4 defined by the guide portion 4. That is, the members composing the guide portion 4 are disposed outside of the detection range 260 of the sheet detection sensor 26. In other words, a possibility that the detection portion detects a detection wave reflected by a shielding object within the apparatus body is lowered by utilizing the space defined by the guide portion 4 as a transmissive portion through which the detection wave from the detection portion passes in the condition in which the opening/closing member is closed. Thus, this simple arrangement makes it possible to prevent the sheet detection sensor 26 from causing an erroneous detection when the tray unit 3 is closed in the arrangement of detecting the sheet S by using the reflection type sensor.

It is noted that the sheet stacking plate 30 of the present embodiment is liftable, and the reflection type sensor whose detection distance is relatively long is used as the sheet detection sensor 26 so as to detect the leaning sheet S1. Even in the case when such reflection type sensor having such long detection distance is used, it is possible to prevent the sheet detection sensor 26 from erroneous detection of the sheet detection sensor 26 when the tray unit 3 is closed by arranging the sheet detection sensor 26 and the guide portion 4 as described above. That is, it is possible to reliably detect the leaning sheet S1 while preventing the sheet detection sensor 26 from erroneous detection.

By the way, in order to downsize the image forming apparatus 100, a thickness of the tray unit 3, i.e., a width in the direction vertical to the upper surface 30*b* of the sheet stacking plate 30, is preferable to be as small as possible. However, the thinner the thickness of the tray unit 3, the deeper the detection range 260 of the sheet detection sensor 26 enters the inside of the apparatus body 90 when the tray unit 3 is closed. In the present embodiment, however, the guide surfaces 45*a* and 46*a* of the upper and lower guide portions 45 and 46 face vertically with each other with the detection range 260 of the sheet detection sensor 26 interposed therebetween in the condition in which the tray unit 3 is closed (see FIG. 7). This arrangement enables the sheet detection sensor 26 to reduce erroneous detection even if the detection range 260 enters deeply inside of the apparatus body 90 and to achieve both the prevention of the erroneous detection of the sheet detection sensor 26 and downsizing of the apparatus.

While the case of using the reflection type sensor using light such as visible light and infrared ray as the detection wave is used as the detection portion detecting the sheet S has been described in the present embodiment, it is also possible to provide another detection portion. For example, an ultrasonic sensor may be used as a detection portion as long as it generates a detection wave toward a sheet S and detects the detection wave reflected by the sheet S. In this case, ultrasonic wave, i.e., sound wave, generated from a piezoelectric member corresponds to the detection wave and a direction in which the ultrasonic wave is emitted (a displacement direction of the piezoelectric member) corresponds to the emission direction. Still further, even in the case of using the reflection type sensor, the sensor may be arranged such that light emission and reception portions are separately disposed instead of the sensor unit in which the light emission and reception portions 26*a* and 26*b* are integrated.

Still further, although the retard separation type feed unit 20 configured to separate a sheet by the retard roller 23 has been described above as the feed portion feeding the sheet S in the present embodiment, a feed portion other than that may be used. For instance, a so-called air feeding type feed portion configured to suction a sheet S to a conveyance belt by suction air or a feed portion including a pad type separation member (separation pad) may be used.

Second Embodiment

Figure 8:
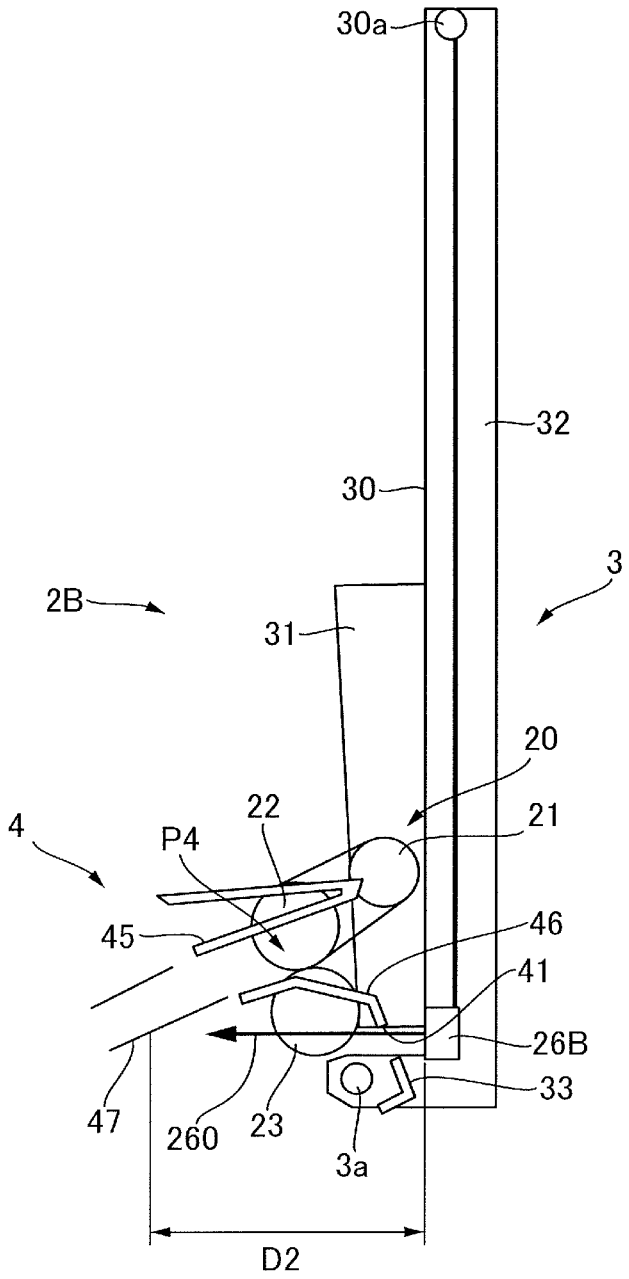
FIG. 8 is a section view illustrating a configuration of a manual sheet feeding apparatus of a second embodiment.

Next, a manual sheet feeding apparatus 2B of a second embodiment will be described below with reference to FIGS. 8 and 9. The manual sheet feeding apparatus 2B of the second embodiment is different from the first embodiment in that a portion defining an opening 41, which serves as a transmissive portion through which a detection wave from the sheet detection sensor 26B passes, is provided at the abutting portion 33. A configuration of the manual sheet feeding apparatus 2B other than that is the same with that of the manual sheet feeding apparatus 2A of the first embodiment.

Similarly to the first embodiment, the sheet detection sensor 26B of the present embodiment is disposed at an end part downstream in the sheet feeding direction (lower side in FIG. 8) of the sheet stacking plate 30. However, the sheet detection sensor 26B is disposed so as to face not the sheet conveyance path P4 but the abutting portion 33, i.e., the regulating portion, in the condition in which the tray unit 3 is closed.

Figure 9:
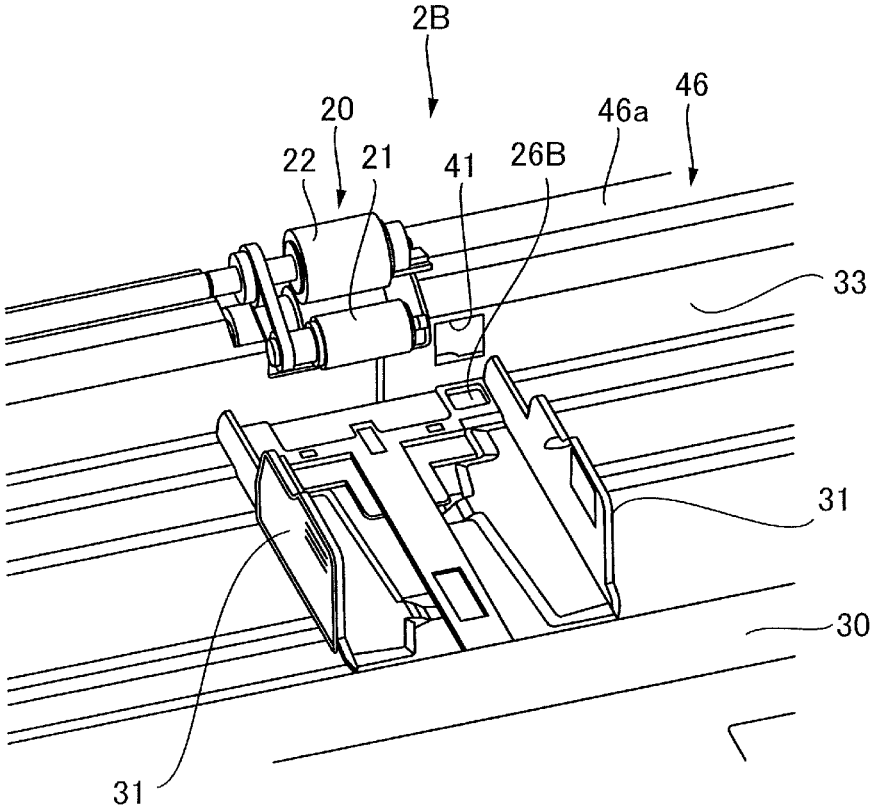
FIG. 9 is a perspective view illustrating the manual sheet feeding apparatus of the second embodiment.

As illustrated in FIG. 9, the opening 41 through which the detection light passes is defined within the abutting portion 33 at a position facing the sheet detection sensor 26B. Still further, a distance D2 from the sheet detection sensor 26B to a structure, e.g., a guide member 47 guiding the sheet S downstream of the guide portion 4, located behind the opening 41 in the emission direction of the detection light is longer than a detection limit distance of the sheet detection sensor 26B.

The detection light projected from the sheet detection sensor 26 passes through the opening 41 and is guided to a fully wide space in the condition in which the tray unit 3 is closed. This arrangement enables the sheet detection sensor 26B to reduce erroneous detection otherwise caused by the detection light reflected by the structure within the apparatus, achieving similar advantages with that of the first embodiment. That is, it is possible to prevent the sheet detection sensor 26 from causing the erroneous detection when the tray unit 3 is closed with the simple structure in the configuration of detecting the sheet S by using the reflection type sensor.

In response to that the present embodiment is also configured such that the sheet stacking plate 30 is liftable with respect to the tray body 32, a detection range of the sheet detection sensor 26B is set to be long in order to detect the leaning sheet S1. This arrangement makes it also possible to prevent the sheet detection sensor 26B from causing an erroneous detection while reliably detecting the leaning sheet S1 by defining the opening 41 through the abutting portion 33.

It is noted that the opening 41 is one example of a low reflectance portion transmitting the detection light, and the transmissive portion may be composed of a material having optical transparency such as glass and transparent resin as long as it is a transmissive member in relation to the detection light. The same applies also to the case of using a signal, e.g., ultrasonic wave, other than light as the detection wave, and the same advantageous effect with the present embodiment can be obtained by composing the low reflectance portion by a material that transmits the detection wave without reflection.

Still further, similarly to the first embodiment, the emission direction of the detection light from the sheet detection sensor 26B may be inclined with respect to the vertical direction of the upper surface 30*b* of the sheet stacking plate 30 corresponding to a positional relationship with the opening 41.

Third Embodiment

Next, a manual sheet feeding apparatus 2C of a third embodiment will be described with reference to FIG. 10. The manual sheet feeding apparatus 2C of the present embodiment is different from that of the second embodiment in that an antireflection sheet 42 that absorbs detection light emitted from the sheet detection sensor 26C is disposed as a low reflectance portion whose reflectance to a detection wave is small. A configuration of the manual sheet feeding apparatus 2C other than that is the same with that of the manual sheet feeding apparatus 2B of the second embodiment, so that same elements with those of the first and second embodiments will be denoted by same reference numerals and a description thereof will be omitted here. Here, the 'reflectance' is a rate of energy of a detection wave reflected by an object to energy of the detection wave incident on the object, and is a ratio of radiant energy in a case of light or a ratio of sound pressure in a case of sound (ultrasonic wave). Still further, the low reflectance portion is what weakens the detection wave reflected toward the detection portion to a degree not detected by the detection portion by either one of or by a combination of transmission, absorption, and scattering of the detection wave emitted from the detection portion.

Figure 10:
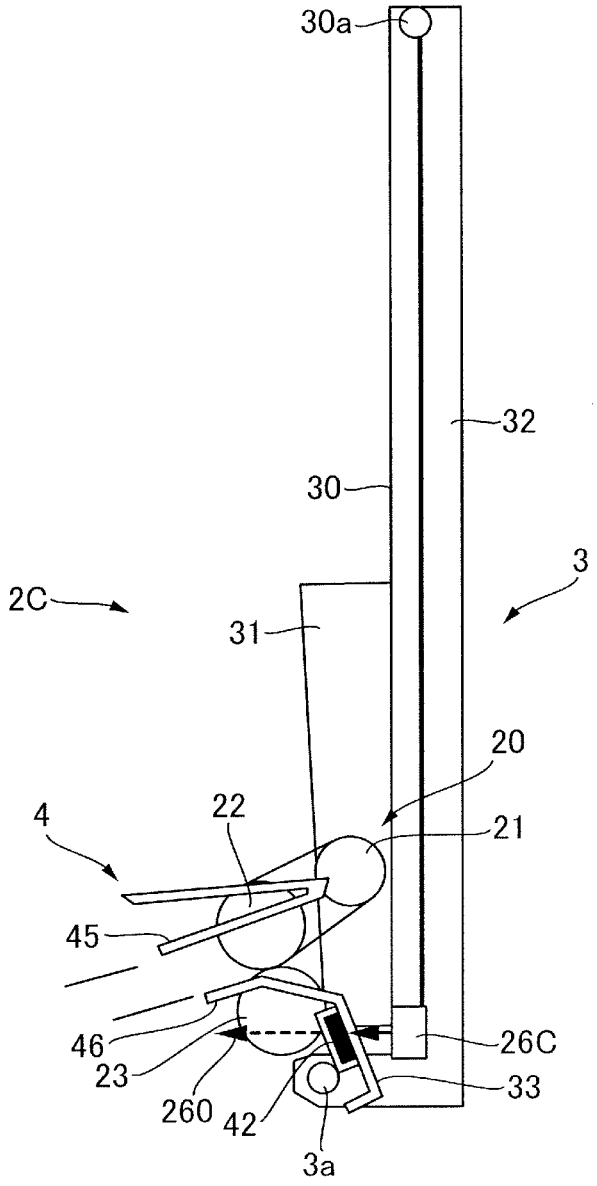
FIG. 10 is a section view illustrating a configuration of a manual sheet feeding apparatus of a third embodiment.

As illustrated in FIG. 10, the sheet detection sensor 26C of the present embodiment is disposed at the end portion downstream in the sheet feeding direction (lower side in FIG. 10) of the sheet stacking plate 30 similarly to the second embodiment and faces the abutting portion 33, i.e., the regulating portion, in the condition in which the tray unit 3 is closed. An opening not illustrated is defined at a position of the abutting portion 33 facing the sheet detection sensor 26C, and the antireflection sheet 42 is disposed at the abutting portion 33 in a manner of fitting into the opening. A black sheet member whose reflectance to visible light is small may be used for example as the antireflection sheet 42.

In the condition in which the tray unit 3 is closed, the detection wave emitted from the sheet detection sensor 26C is sufficiently absorbed by the antireflection sheet 42. This arrangement makes it possible to prevent the sheet detection sensor 26C from causing an erroneous detection, thereby achieving similar advantages with the second embodiment. That is, it is possible to prevent the sheet detection sensor 26C from causing an erroneous detection when the tray unit 3 is closed with a simple structure in the arrangement of detecting the sheet S by using the reflection type sensor.

Still further, in response to the arrangement in which the sheet stacking plate 30 is liftable with respect to the tray body 32, a detection range of the sheet detection sensor 26C is set to be relatively long to be able to detect a leaning sheet S1. This arrangement, in which the antireflection sheet 42 is disposed at the abutting portion 33, makes it possible to prevent the sheet detection sensor 26C from causing an erroneous detection while permitting to detect the leaning sheet S1.

It is noted that the antireflection sheet 42 is one example of the low reflectance portion and may be made by applying paint, for example, whose reflectance to the detection wave is small to a part or a whole of the abutting portion 33. It is also possible to arrange such that the reflectance is lowered by absorbing the detection wave by fine irregularities formed on the surface of the abutting portion 33. In this case, the surface treated area corresponds to the low reflectance portion. Reflectance of such low reflectance portion is lower than that of surrounding portions around the low reflectance portion, i.e., a part of the abutting portion 33 not treated as the low reflectance portion. The same applies also to a case of using a physical phenomenon other than light as the detection wave, and the same advantageous effect with the present embodiment may be obtained by composing the low reflectance portion by a material, e.g., a rubber material in a case of ultrasonic wave, which absorbs or dissipates the detection wave. It is noted that while the case of providing the low reflectance portion in the abutting portion 33 has been described above, the present disclosure is not limited to such configuration. In a case when a part facing the sheet detection sensor 26C is not the abutting portion 33 when the tray unit 3 is closed, the low reflectance portion may be provided at that part. Still further, the part composing the low reflectance portion may be provided only at the part facing the sheet detection sensor 26C when the tray unit 3 is closed. For instance, a structure for the low reflectance portion may be provided at a part of the abutting portion 33. This arrangement makes it possible to reduce costs more than a case when a structure for preventing the reflection is provided on the whole part of the abutting portion 33.

Still further, similarly to the second embodiment, the emission direction of the detection light emitted from the sheet detection sensor 26C may be inclined with respect to the vertical direction of the upper surface 30*b* of the sheet stacking plate 30 corresponding to a positional relationship with the antireflection sheet 42.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-073539, filed on Mar. 31, 2016, which is hereby incorporated by reference herein in its entirety.

What is claimed is:

1. A sheet feeding apparatus comprising:

an apparatus body;

an opening/closing member openable and closable with respect to the apparatus body and comprising a support portion configured to support a sheet in a condition in which the opening/closing member is opened;

a feed portion configured to feed the sheet supported on the support portion; and a detection portion disposed in the opening/closing member and configured to emit a detection wave in a direction intersecting with a support surface of the support portion and detect the detection wave reflected by the sheet on the support surface, the detection portion being disposed at a position where the detection wave emitted from the detection portion is not detected by the detection portion in a condition in which the opening/closing member is closed.

2. The sheet feeding apparatus according to claim 1, further comprising a transmissive portion through which the detection wave emitted from the detection portion passes, the transmissive portion being disposed at a position facing the detection portion in a condition in which the opening/closing member is closed.

3. The sheet feeding apparatus according to claim 2, further comprising a conveyance guide configured to guide the sheet fed by the feed portion, wherein the transmissive portion is a sheet conveyance path defined by the conveyance guide, and the detection portion is disposed such that the detection wave is emitted in a direction passing through inside of the sheet conveyance path in a condition in which the opening/closing member is closed.

4. The sheet feeding apparatus according to claim 3, wherein the conveyance guide comprises a first guide portion configured to be in a sliding contact with a first surface of the sheet, and a second guide portion configured to be in a sliding contact with a second surface opposite to the first surface of the sheet and defining the sheet conveyance path with the first guide portion, and wherein the first and second guide portions face each other with a detection range of the detection portion between the first and second guide portions in a condition in which the opening/closing member is closed.

5. The sheet feeding apparatus according to claim 2, further comprising a regulating portion which is disposed in the apparatus body and against which the sheet supported on the support portion abuts so that a position of the sheet in a sheet feeding direction of the feed portion is regulated in a condition in which the opening/closing member is opened, and wherein the transmissive portion is disposed at the regulating portion.

6. The sheet feeding apparatus according to claim 5, wherein the transmissive portion comprises a portion defining an opening within the regulating portion.

7. The sheet feeding apparatus according to claim 2, wherein the detection portion is disposed at a position distant from a shielding object facing the detection portion by more than a detection limit distance of the detection portion in an emission direction in which the detection wave is emitted in a condition in which the opening/closing member is closed, the detection limit distance being a distance beyond which the sheet is not detected by the detection portion.

8. The sheet feeding apparatus according to claim 1, further comprising a low reflectance portion disposed in the apparatus body and facing the detection portion in a condition in which the opening/closing member is closed, wherein reflectance of the low reflectance portion to the detection wave emitted from the detection portion is lower than that of surrounding portions of the low reflectance portion.

9. The sheet feeding apparatus according to claim 8, further comprising a regulating portion which is disposed in the apparatus body and against which the sheet supported on the support portion abuts so that a position of the sheet in a sheet feeding direction of the feed portion is regulated in a condition in which the opening/closing member is opened, wherein the low reflectance portion is disposed at the regulating portion.

10. The sheet feeding apparatus according to claim 1, wherein the detection portion is configured to emit the detection wave in a condition in which the opening/closing member is opened and a condition in which the opening/closing member is closed.

11. The sheet feeding apparatus according to claim 1, wherein the feed portion is configured to execute a feed operation of feeding the sheet in a condition in which the detection wave is detected by the detection portion and to execute no feed operation in a condition in which the detection wave is not detected by the detection portion.

12. The sheet feeding apparatus according to claim 1, wherein the detection wave is light or sound wave.

13. The sheet feeding apparatus according to claim 8, wherein the detection wave is light, and the low reflectance portion comprises a material adsorbing the light emitted from the detection portion.

14. The sheet feeding apparatus according to claim 1, wherein the feed portion comprises a feed member configured to come into contact with an upper surface of the sheet supported on the support portion to feed the sheet, a conveyance member configured to receive the sheet fed from the feed member and convey the sheet, and a separation member configured to separate the sheet conveyed by the conveyance member from other sheets, and wherein the detection portion is configured to detect the sheet nipped between the conveyance member and the separation member.

15. The sheet feeding apparatus according to claim 14, wherein the support portion is configured to move upward and downward with respect to a bottom part of the opening/closing member so as to move the sheet supported on the support portion between a feed position where the sheet supported on the support portion comes into contact with the feed member and a standby position below the feed position.

16. The sheet feeding apparatus according to claim 14, further comprising a pair of side end regulating members supported by the opening/closing member, being movable in a width direction orthogonal to a sheet feeding direction of the feed portion, and configured to regulate a position of the sheet supported on the support portion in the width direction, and wherein the detection portion is disposed downstream of an abutment position where the feed member comes into contact with the sheet in terms of the sheet feeding direction and is disposed at a position which does not overlap with the feed member and which is located between movable ranges of the respective side end regulating members in terms of the width direction.

17. The sheet feeding apparatus according to claim 1, wherein the detection portion is a photoelectric sensor comprising a light emission portion configured to emit light as the detection wave and a light reception portion configured to detect the light reflected by the sheet.

18. The sheet feeding apparatus according to claim 17, wherein the light emission portion is disposed in the support portion and configured to emit the light in a direction inclined with respect to a direction vertical to the support surface of the support portion.

19. An image forming apparatus, comprising:

an image forming portion configured to form an image on a sheet; and the sheet feeding apparatus as set forth in claim 1 and configured to feed the sheet to the image forming portion.

20. A sheet feeding apparatus comprising:

an apparatus body;

an opening/closing member openable and closable with respect to the apparatus body and comprising a support portion configured to support a sheet in a condition in which the opening/closing member is opened;

a feed portion configured to feed the sheet supported on the support portion;

a conveyance guide disposed in the apparatus body and configured to guide the sheet fed by the feed portion, the conveyance guide comprising a first guide portion configured to be in sliding contact with a first surface of the sheet conveyed by the feed portion and a second guide portion configured to be in sliding contact with a second surface opposite to the first surface of the sheet; and a detection portion disposed in the opening/closing member and configured to emit a detection wave in a direction intersecting with a support surface of the support portion and detect the detection wave reflected by the sheet on the support surface, the detection portion being disposed at a position overlapping with an opening of a sheet conveyance path defined between the first and second guide portions when viewed from a direction in which the detection wave is emitted from the detection portion in a condition in which the opening/closing member is closed.

21. A sheet feeding apparatus comprising:

an apparatus body;

an opening/closing member openable and closable with respect to the apparatus body and comprising a support portion configured to support a sheet in a condition in which the opening/closing member is opened;

a feed portion configured to feed the sheet supported on the support portion;

a conveyance guide disposed in the apparatus body and configured to guide the sheet fed by the feed portion; and a detection portion disposed in the opening/closing member and configured to emit a detection wave in a direction intersecting with a support surface of the support portion and detect the detection wave reflected by the sheet on the support surface, the detection portion being disposed at a position where the detection wave is emitted by the detection portion in a direction passing through inside of a sheet conveyance path defined by the conveyance guide in a condition in which the opening/closing member is closed.

22. A sheet feeding apparatus comprising:

an apparatus body;

an opening/closing member openable and closable with respect to the apparatus body and comprising a support portion configured to support a sheet in a condition in which the opening/closing member is opened;

a feed portion configured to feed the sheet supported by the support portion;

a detection portion disposed in the opening/closing member and configured to emit a detection wave in a direction intersecting with a support surface of the support portion and detect the detection wave reflected by the sheet on the support surface; and a regulating portion which is disposed in the apparatus body and against which the sheet supported on the support portion abuts so that a sheet position in a sheet feeding direction of the feed portion is regulated in a condition in which the opening/closing member is opened, the regulating portion comprising a transmissive portion through which the detection wave emitted from the detection portion passes, wherein the detection portion is disposed at a position where the detection wave is emitted in a direction passing through the transmissive portion in a condition in which the opening/closing member is closed.

23. A sheet feeding apparatus comprising:

an apparatus body;

an opening/closing member openable and closable with respect to the apparatus body and comprising a support portion configured to support a sheet in a condition in which the opening/closing member is opened;

a feed portion configured to feed the sheet supported on the support portion;

a detection portion disposed in the opening/closing member and configured to emit a detection wave in a direction intersecting with a support surface of the support portion and detect the detection wave reflected by the sheet on the support surface; and a low reflectance portion disposed in the apparatus body and facing the detection portion in a condition in which the opening/closing member is closed, the low reflectance portion having reflectance to the detection wave from the detecting portion lower than that of surrounding portions of the low reflectance portion.

* * * * *